United States Patent [19]

Tanaka

[11] 4,045,951

[45] Sept. 6, 1977

[54] DIGITAL ELECTRONIC TIMEPIECE

[75] Inventor: Kojiro Tanaka, Yachiyo, Japan

[73] Assignee: Kabushiki Kaisha Daini Seikosha, Japan

[21] Appl. No.: 642,378

[22] Filed: Dec. 19, 1975

[30] Foreign Application Priority Data

Dec. 20, 1974 Japan ..... 49-147273

[51] Int. Cl.[2] ..... G04C 3/00

[52] U.S. Cl. ..... 58/23 R; 58/152 R; 58/50 R

[58] Field of Search ..... 58/23 R, 85.5, 50 R, 58/152 R

[56] References Cited

U.S. PATENT DOCUMENTS

| | | | |
|---|---|---|---|
| 3,646,751 | 3/1972 | Purland et al. | 58/152 R |
| 3,867,619 | 2/1975 | Arauchi | 58/152 R |
| 3,937,004 | 2/1976 | Natori et al. | 58/50 R |
| 3,946,549 | 3/1970 | Cake | 58/50 R |

*Primary Examiner*—Robert K. Schaefer
*Assistant Examiner*—Vit W. Miska
*Attorney, Agent, or Firm*—Robert E. Burns; Emmanuel J. Lobato; Bruce L. Adams

[57] ABSTRACT

A digital electronic timepiece, including time measuring means, a display means for displaying a time determined by said time measuring means and for displaying time table information, a memory means for memorizing time table information, and a control means for controlling display of the contents of said memory means. When the time determined by the measuring means coincides with the displayed time information from the memory means, a control signal is applied to the memory means and the next successive time of the time table is displayed. The time information displayed may be time table information including train and working time.

6 Claims, 1 Drawing Figure

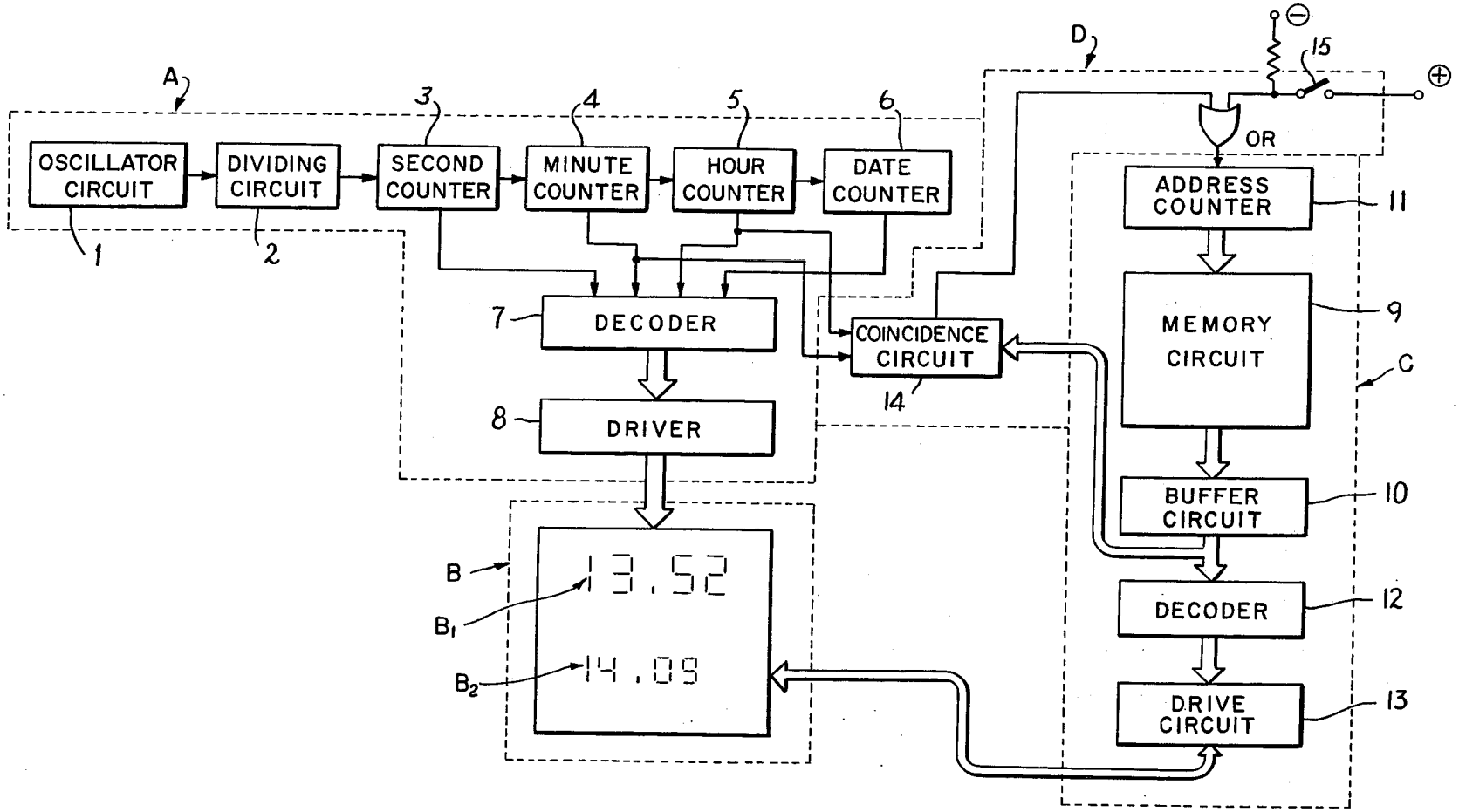
OSCILLATOR CIRCUIT
DIVIDING CIRCUIT
SECOND COUNTER
MINUTE COUNTER
HOUR COUNTER
DATE COUNTER
DECODER
DRIVER
COINCIDENCE CIRCUIT
ADDRESS COUNTER
MEMORY CIRCUIT
BUFFER CIRCUIT
DECODER
DRIVE CIRCUIT
OR
A
B
C
D
B1
B2
1
2
3
4
5
6
7
8
9
10
11
12
13
14
15

DIGITAL ELECTRONIC TIMEPIECE

BACKGROUND OF THE INVENTION

This invention relates to a digital electronic timepiece able to display time table information, including a train and working time table on a digital display means.

In the conventional type of digital electronic timepiece a display means for displaying time table information including train and working time is not included. Therefore, it is very inconvenient to known time table information since a time table book or sheets must be consulted. Then, the time table information must be compared with a present time indicated by a timepiece in order to determined where the present time lies with respect to the schedule of activities.

OBJECT OF THE INVENTION

The present invention aims to eliminate the above noted difficulty and insufficiency, and therefore it is the primary object of the present invention to provide a means for displaying time table information with an electronic digital timepiece.

Another object of the invention is to provide a digital timepiece which automatically displays successive times from a time table.

It is another object of the invention to provide a digital timepiece which simultaneously displays a present time and a time from a time table, and which is operable to either automatically or manually display successive times from the time table.

SUMMARY OF THE INVENTION

A digital electronic timepiece comprising a time measuring means for developing a digital signal continually representative of present time, memory means addressable for reading-out a sequence of time information representative of successive times and each stored in a successive address of the memory means, display means cooperative with the time measuring means and the memory means for simultaneously displaying the present time and the time information read-out from the memory means, and control means for developing a control signal when the present time and time information coincide and for applying the control signal to the memory means for reading-out time information stored in a next successive address each time the present time and the time information coincide.

BRIEF DESCRIPTION OF THE DRAWING

The above mentioned and further objects, features and advantages of the present invention will become more apparent from the following description when taken in connection with the accompanying drawing, which illustrates a black diagram of the structure of one preferred embodiment a digital electronic timepiece according to the present invention.

DETAILED DESCRIPTION OF THE INVENTION

This invention relates to a digital electronic timepiece able to display time table information, including a train and working time table, on a digital display means.

The drawing is the block diagram of the digital electronic timepiece of the present invention which is composed of a time measuring means $A_1$ a digital display means $B_1$ a memory means C for memorizing time table information of a train or working time table, and a controlling means D.

Said time measuring means is composed of a quartz oscillating circuit 1 and a dividing circuit for dividing an oscillator signal of 32,768 HZ to a one $H_2$ signal. The signal from said dividing circuit 2 is shaped to a pulse wave and then applied to the second counter 3, the second output signal of said second counter 3 is applied to the minute counter 4, the hour output signal of said minute counter 4 is applied to the hour counter 5, and the day signal output of said hour counter 5 is applied to the day counter 6.

The second, minute, hour and day signals respectively counted by said counters 3–6 are decoded by the decoder 7 and then applied to the driving circuit 8 whereby said display means B, which is composed of a liquid crystal and light emitting diode, is operated. The display section $B_1$ of said display means displays the second, minute, hour and day in digital form.

On the other hand, said memory means is composed of the memory circuit 9 for memorizing the train or working time table of one day, and the address counter 11 for sequentially designating addresses of said memory circuit 9 in order to sequentially read the time information of the memory address which being designated.

The time information is applied to said buffer circuit 10, decoded by the decoder 12, and the decoded time information is applied to the driving circuit 13. Said driving circuit 13 is operated in response to the input decoded time information and operates the display means $B_1$ whereby the time information said memory circuit 9 is displayed at the display section $B_2$.

Further, said controlling means D is composed of the coincidence circuit 14 for applying the clock signal to said address counter 11, and the manual switch 15 operable for generating the clock signal. The time information (including hour and minute) from said buffer circuit 10 in said memory means C is applied to said coincidence circuit 14, and further minute and hour information from said minute and hour counters 4 and 5 are applied to said coincidence circuit 14.

When said time information (including hour and minute) from said buffer circuit 10 and minute and hour information from said minute and hour counters 4 and 5 coincide, whereby a coincidence signal is generated. Then said coincidence signal is applied to the address counter 11 via OR-gate "OR" as the clock signal and the address counter 11 is operated. Further, when said manual switch 15 is operated to the ON-position, the signal developed upon closure of said manual switch 15 is applied to said address counter 11 via said OR-gate "OR", and said address counter 11 is operated.

Following is a description of the operation of the electronic timepiece of the present invention.

The signals of said second, minute, hour and day counters are decoded by said decoder 7, and are applied to said display means B via said driving circuit 8 whereby the display section $B_1$ of said display means B is operated. For example, the time of 13:52 is displayed (the display of second and day is omitted in this drawing).

Further, the train time table is memorized in said memory circuit 9. A preferable train starting time, for example 14:09, stored in said memory circuit 9 is decoded by said address counter 11, and this information is displayed on said display means B.

In the above noted situation, when the displayed time in said display section $B_1$ coincides with the displayed train starting time, namely 14:09 displayed in said display section $B_2$, the counting signals of said minute counter 4 and hour counter 5 coincide with the time information from said buffer circuit 10 of said memory means whereby the pulse signal is generated by said coincidence circuit 14.

When said pulse signal of said coincidence circuit 14 is applied to said address counter 11 via said OR-gate "OR" said address counter 11 is operated, the next successive train starting time information from the next successive memory address which is designated upon operation of the address counter 11 is applied to said buffer circuit 10. Said time information from the memory circuit 9 is applied to said display section $B_2$ via said decoder 12 and driving circuit 13 whereby the next successive train starting time, for example 14:30, is displayed.

Whenever the time determined by said time measuring means A coincides with the time of said display section $B_2$, said address counter 11 is operated whereby the memory information of said memory circuit 9 is sequentially displayed, and said memory information is displayed on said display section $B_2$. Further, when said manual switch 15 is operated to ON and OFF, the signal of said manual switch 15 is applied to said address counter 11 as the clock pulse whereby said address counter 11 is sequentially operated.

Therefore, the time information of said memory circuit 9 is sequentially displayed on said display section $B_2$ according to the operation of said address counter 11, and is displayed independently of the displayed time of said display section $B_1$. As a result, one can easily consult or verify the time table contents of the trains scheduled after the present time determined by the time measuring A.

The construction of the memory circuit of the present invention is very useful for storing a train starting time table, the working time table for a mass-communication system, and other time table. It is useful in this situation, if many kinds of memory means are provided for many purposes, that the memory means are freely respectively interchangeable . Further it is very useful to rewrite the contents of one memory means according to its intended use.

According to the present invention, the memory means for memorizing many kinds of time table information, the controlling means for displaying the contents of said memory means on the display means, the time measuring means and the display means are respectively constructed as one circuit, whereby it is possible to display the time of the time measuring means and the contents of said memory means. It is very useful for busy people.

Further it is possible to operate an alarm means when said time of display sections $B_1$ and $B_2$ coincide.

What I claim is

1. A digital electronic timepiece comprising in combination:

time measuring means including an oscillator circuit for developing an output signal at a certain frequency, a dividing circuit connected to receive the oscillator output signal for developing output pulses at a frequency lower than the frequency of the oscillator output signal, and a counter connected to receive the output pulses from the dividing circuit for counting the same to develop a pulse count representative of time;

memory means having a plurality of successive addresses for memorizing time table information representative of different times and being successively addressable by a control signal for reading-out successive memorized times;

display means connected to receive the pulse count representative of time and successive times read-out from said memory means for simultaneously displaying a time represented by the pulse count and a time read-out from said memory means; and control means comprising a coincidence circuit connected to compare the pulse count with the read-out contents of said memory means for developing a control signal when the times respectively represented by the pulse count and the read-out contents of said memory means coincide, thereby to read-out a next successive time memorized in said memory means and display the same.

2. A digital electronic timepiece according to claim 1, wherein said memory means includes an address counter receptive of the control signal or changing a count stored therein and corresponding to an address of said memory means; and means for applying the count stored in said address counter to said memory means for reading-out time information memorized in said memory means; said address counter developing a count which successively changes with each successive control signal applied thereto for reading-out time information memorized in successive addresses of said memory means, thereby to successively display successive times stored in said memory until the time determined by said time measuring means coincides with a displayed memorized time whereupon said coincidence circuit develops a control signal to advance said address counter thereby to read-out the information stored in a next successive address and corresponding to a next successive time.

3. A digital electronic timepiece according to claim 2, wherein said control means further includes:

a manually operable switch operable between open and closed conditions; and an OR gate having an output port connected to apply an OR gate output signal to said address counter for controlling the advance of the count stored therein, a first input port connected to said coincidence circuit for receiving the control signal thereby to apply the control signal through said OR gate to control said address counter, and a second input port connected to said switch for receiving a voltage applied under control of said switch through said OR gate to control said address counter whereby said memory means is addressable either automatically under control of said coincidence circuit or manually under control of said switch.

4. A digital electronic timepiece comprising in combination time measuring means for developing a periodically changing digital signal continually representative of present time;

memory means addressable for reading-out a sequence of stored time information representative of successive times and each stored in a successive address of said memory means;

display means cooperative with said time measuring means and said memory means for simultaneously displaying the present time and time information read-out from said memory means; and control means responsive to the periodically changing digital signal developed by said time measuring means and responsive to the time information read-out from said memory means for developing a control signal when the present time and the time information coincide and for applying the control signal to said memory means for reading-out time information stored in a next successive address each time the present time and the time information coincide.

5. A digital electronic timepiece according to claim 4, wherein said control means further comprises: manual read-out means manually operable for successively reading-out time information stored in successive ones of the memory means address for successively displaying the successive times represented by the time information stored in said memory means independent of the present time determined by said time measuring means.

6. A digital electronic timepiece according to claim 5, wherein said control means comprises a coincidence circuit responsive to the time information read-out from said memory means and responsive to the digital signal representative of present time for developing a coincidence signal when the read-out time and the present time coincide; a manually operable switch comprising said manual read-out means and operable between open and closed conditions; and an OR gate having an output port connected to apply an OR gate output control signal to said memory means for reading-out time information therefrom, a first input port connected to said coincidence circuit for receiving the coincidence signal thereby to apply the coincidence signal through said OR gate as the control signal to said memory means, and a second input port connected to said switch for receiving a voltage applied under control of said switch through said OR gate as the control signal to said memory means.

* * * * *